US007527004B1

(12) United States Patent
White et al.

(10) Patent No.: US 7,527,004 B1
(45) Date of Patent: May 5, 2009

(54) METHOD AND APPARATUS FOR HOOPING AN ARTICLE FOR AN EMBROIDERY MACHINE

(76) Inventors: Miller Eugene White, 76 Kisatchie Hills, Boyce, LA (US) 71409-0076; Karen Selena Burns White, 76 Kisatchie Hills, Boyce, LA (US) 71409-0076

( * ) Notice: Subject to any disclaimer, the term of this patent is extended or adjusted under 35 U.S.C. 154(b) by 0 days.

(21) Appl. No.: 11/825,951

(22) Filed: Jul. 10, 2007

Related U.S. Application Data

(60) Provisional application No. 60/819,937, filed on Jul. 12, 2006.

(51) Int. Cl.
*D05C 9/04* (2006.01)
*D05B 39/00* (2006.01)

(52) U.S. Cl. ..... 112/103

(58) Field of Classification Search ..... 112/103, 112/475.01, 475.18, 439, 117, 470.09; 38/102.91, 38/102.8, 102.2, 102.21, 102.1
See application file for complete search history.

(56) References Cited

U.S. PATENT DOCUMENTS

| | | | | | |
|---|---|---|---|---|---|
| 1,895,715 | A | * | 1/1933 | James | 38/102.21 |
| 4,357,885 | A | * | 11/1982 | Stockton | 112/103 |
| 4,530,665 | A | * | 7/1985 | Colonel | 434/95 |
| 4,762,076 | A | * | 8/1988 | Wakaizumi | 112/103 |
| 4,774,778 | A | | 10/1988 | Williams | |
| 5,432,990 | A | * | 7/1995 | Seneff | 29/251 |
| 5,546,877 | A | * | 8/1996 | Moore | 112/103 |
| 5,884,571 | A | | 3/1999 | Valdez et al. | |
| 5,915,315 | A | | 6/1999 | Bentz | |
| 5,934,210 | A | * | 8/1999 | Lucchese | 112/103 |
| 5,992,339 | A | | 11/1999 | Mack | |
| 6,067,737 | A | * | 5/2000 | Guenther | 38/102.2 |
| 6,116,174 | A | * | 9/2000 | Melton | 112/103 |
| 6,138,592 | A | * | 10/2000 | Seneff | 112/103 |
| 6,155,189 | A | * | 12/2000 | Walner | 112/475.01 |
| 6,212,800 | B1 | * | 4/2001 | Bagley | 38/102.1 |
| 6,216,617 | B1 | * | 4/2001 | Burt, Jr. | 112/103 |
| 6,298,800 | B1 | | 10/2001 | Gala | |
| 6,679,190 | B1 | | 1/2004 | French et al. | |
| 6,691,631 | B2 | | 2/2004 | Pettigrew et al. | |
| 6,775,934 | B1 | | 8/2004 | Gallik et al. | |
| 6,832,569 | B2 | * | 12/2004 | Krasnitz | 112/475.18 |
| 7,178,256 | B2 | | 2/2007 | Roche | |
| 7,194,967 | B2 | * | 3/2007 | Bowlus | 112/103 |
| 2004/0154512 | A1 | | 8/2004 | Krasnitz | |
| 2005/0120931 | A1 | | 6/2005 | Manson | |
| 2006/0272565 | A1 | | 12/2006 | Bowlus | |
| 2006/0278148 | A1 | | 12/2006 | Lord et al. | |

* cited by examiner

*Primary Examiner*—Ismael Izaguirre

(57) ABSTRACT

A method and apparatus for aligning a design template on a fabric article to be embroidered is disclosed. The method and apparatus allows for alignment of the template on the fabric article while hooping only the embroidery backer. The alignment apparatus comprises a base having a slide bar and knobs. The slide bar and knobs may be positioned to hold an embroidery hoop in a secured position on the base. The base is configured so that an inner edge of a hoop placed on the base is only partially obstructed by the base. A user may hoop a backer only, and not an article to be embroidered, by the method of hooping the backer, placing the hoop on the alignment apparatus, placing the article to be embroidered over the backer, and placing pins around the inner edges of the unobstructed portions of the hoop.

15 Claims, 8 Drawing Sheets

METHOD AND APPARATUS FOR HOOPING AN ARTICLE FOR AN EMBROIDERY MACHINE

This application claims priority to U.S. provisional application No. 60/819,937 filed Jul. 12, 2006, by applicants.

FIELD OF INVENTION

The present invention relates to the embroidery industry. More particularly, the present invention relates to a method and apparatus for aligning a design template on an article to be embroidered, while hooping only the backer.

BACKGROUND OF INVENTION

Embroidery is a popular method of decorating articles of clothing and fabrics. The embroidery industry is generally divided into commercial and home markets. Both commercial and home markets generally use an inner and outer set of embroidery rings, usually called a hoop, to aid in the embroidery process. A design template is first positioned on the article to be embroidered. The design template outlines the pattern which will be embroidered. The design template is overlaid by a grid pattern containing central axis lines, which aids in the alignment of the design template. In order to provide support and stability to the article to be embroidered, a backer or stabilizer is generally placed behind or beneath the article. As is well known, the backer and article to be embroidered are then simultaneously placed between the male and female hoop portions. Once the portion of the article to be embroidered is properly framed by the hoop portions, the male hoop portion is then seated within the female hoop portion, thereby securing the backer and article between the hoop portions by friction. The hoop can be any closed configuration such as a circle, square, rectangle or otherwise. Various home embroidery machines require distinct hoops for proper operation. In the commercial market, a mechanical press is used to force the male and female hoop portions together. In the home market, the male and female hoop portions are usually forced together by hand. The process of forcing the male and female hoop portions together is referred to as hooping.

In the embroidery industry, the manufacturer of the embroidery machine customarily provides a grid, to be used in conjunction with the hoop. The grid is typically made of translucent plastic and is overlaid with a grid pattern containing central axis lines. The plastic grid typically has a hole in the center of the grid and additional holes corresponding to the ends of each central axis line of the grid pattern. The plastic grid, when placed in the hoop, allows the user to locate the center of the hoop. This plastic grid also aids the user in aligning and positioning the article to be embroidered within the hoop. An article to be embroidered may be aligned and positioned within the hoop by aligning the grid pattern of the plastic grid with the grid pattern of the design template, and then hooping the article and backer.

In the embroidery industry, an attachment boom is usually provided on the female hoop portion. This attachment boom permits the male and female hoop portions, and the backer and article secured therebetween, to be secured to the embroidery machine for the embroidery operation. This also permits a ganged embroidery machine to embroider a number of garments at one time rather than a single garment.

An embroidery machine is limited to embroidering the area within the hoop. However, designs larger than the hoop may be embroidered by hooping a section to be embroidered, embroidering the section within the hoop, unhooping the embroidered section, and then repositioning and rehooping the adjacent section of the article.

During the process of hooping the backer and the article, the article may shift from its intended position within the hoop. This can make it difficult to correctly position an embroidered design or to align adjacent designs on an article. There are also other disadvantages of the prior art that will be understood by those skilled in the art.

SUMMARY OF INVENTION

An embodiment of the present invention provides an improved method of hooping only the backer, and not the article to be embroidered, and an alignment apparatus to be used in connection therewith. In one embodiment of the present invention the alignment apparatus is a base having at least one holding member. The holding members may be any form of knob, clamp, brace, bracket or similar device which is capable of securing a hoop on the base. The holding members secure a hoop on the base in such a manner that only a portion of the edges of a hoop are obstructed or backed by the alignment apparatus when a hoop is placed on the alignment apparatus. Portions of the alignment apparatus are constructed of a penetrable material which can be penetrated by a pin.

In one embodiment of the present invention the alignment apparatus is a base having vertical and horizontal arms, which symmetrically intersect to form a cross shape. A channel, groove or indentation is contained within the center of each arm. The channel, groove or indentations extend from the base cross center point, longitudinally toward the ends of each arm. The channel, groove or indentations are filled with a penetrable material such as foam core board, cork or any other suitable material which can be penetrated by a pin.

Each of the two vertical arms and one of the two horizontal arms has a plurality of holes or apertures near the outer edges of each arm extending from near the center point of the cross to the end of each arm. The alignment apparatus includes a plurality of knobs with an off centered hole or aperture traversing the knob. The holes in the arms and the knobs are suited to receive a bolt, screw or any other similar shaft. A nut, wing nut, or similar attachment device is threadedly connected to the bolt, screw or shaft and secures the knobs to the arms. The knobs may be repositioned on the arm by removing the nut and moving the knob to another hole along the arm and re-securing the knob to the arm. The knobs may be finely adjusted by loosening the nut, and rotating the knobs until the knobs are in the desired position.

The remaining horizontal arm has a pair of holes or apertures. The alignment apparatus includes a slide bar having two parallel slots extending through the slide bar and spanning the majority of the width of the slide bar. The holes in the arm and the slots in the slide bar are suited to receive a bolt, screw or any other similar shaft. A nut, wing nut, or similar attachment device is threadedly connected to each bolt, screw or shaft and secures the slide bar to the arm. The slid bar may be adjusted by loosing the nuts, moving the slide bar into the desired position, and retightening the nuts.

The slide bar has grooves, recesses and projections that allow the slide bar to mate with the attachment boom of a variety of hoops from a variety of manufactures. These grooves, recesses and projections allow the slide bar to hold the hoop in a secured position on the alignment apparatus.

The alignment apparatus is configured so that only a portion of edges of a hoop are obstructed or backed by the arms of the alignment apparatus when a hoop is placed and centered on the alignment apparatus.

The alignment apparatus may be used as an aid in the method of hooping only the backer, and not the article to be embroidered. The hoop is first placed on the alignment apparatus in such a way that the hoop attachment boom corresponds to the arm of the alignment apparatus which contains the slide bar. The plastic grid is then placed in the hoop. The slide bar and knobs are then positioned and adjusted so that the hoop is securely held in a central location on the alignment apparatus. The hoop is removed from the alignment apparatus. The user hoops the backer only. The hoop is placed in the alignment apparatus. A mark is made on the backer through each of the five holes in the plastic grid. The plastic grid is removed and guide lines are drawn connecting the marks in such a way that the lines intersect at the center mark.

A design template is placed on the article to be embroidered. The design template is positioned on the article, and then pinned in place. A pin is then placed through the design template at the intersection of the two lines, representing the design template cross center point. The pin is then placed through the article. The pin is then placed through the backer at the intersection of the two guide lines on the backer representing the backer cross center point. The pin is then placed into the penetrable material of the alignment apparatus. Additional Pins are then placed through the design template guide lines and through the article to be embroidered. The pins are then placed through the guide lines of the backer and into the penetrable material of the alignment apparatus.

Pins are then placed through the article and backer, along the inner edges of the hoop that are not obstructed or backed by the arms of the alignment apparatus. In this manner, the five pins that penetrate the penetrable material of the alignment apparatus hold the design template in precise position relative to the hoop while pins are placed around the unobstructed edges of the hoop. The user then lifts the hoop off of the alignment apparatus and continues pinning around the inner edges of the hoop in the areas that were previously obstructed by the arms of the alignment apparatus.

The design template is then unpinned and removed from the article and the hoop, article and backer assembly is placed in the embroidery machine. The embroidery machine then embroiders the design on the article.

In an alternative embodiment of the present invention, the user does not remove the design template before placing the hoop, article and backer assembly into the embroidery machine. Instead, the hoop, design template, article and backer assembly is placed into the embroidery machine. The needle of the embroidery machine is lowered to ensure that the needle penetrates the design template cross center point. The design template is then removed and the embroidery machine embroiders the design on the article.

DETAILED DESCRIPTION

Figure 1:
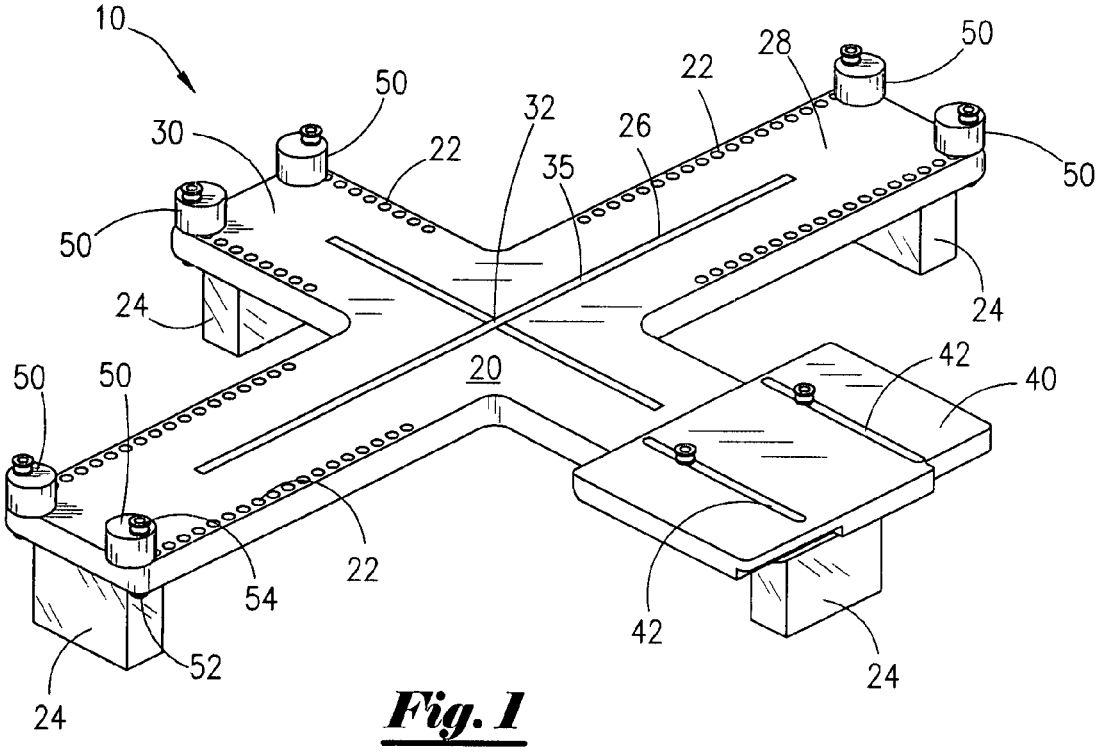
FIG. 1 is an isometric view depicting the top of an embodiment of applicant's invention.

Referring now to the drawings, there is shown an embodiment of an alignment apparatus having a base, slide bar and knobs. Referring more particularly to FIG. 1, there is shown an alignment apparatus (10) having a base (20), a slide bar (40) and knobs (50). The base (20) has a plurality of base holes (22). The base (20) rests upon base supports (24). The base has base channels (26) which extend longitudinally towards the ends of the vertical arm (28) and the horizontal arm (30). The channels of the vertical and horizontal arms intersect at a base cross center point (32). A slide bar (40) may be secured or attached to the base (20). Knobs (50) may be secured or attached to the base (20) by bolts (52) which are threadedly connected to nuts (54).

Figure 2:
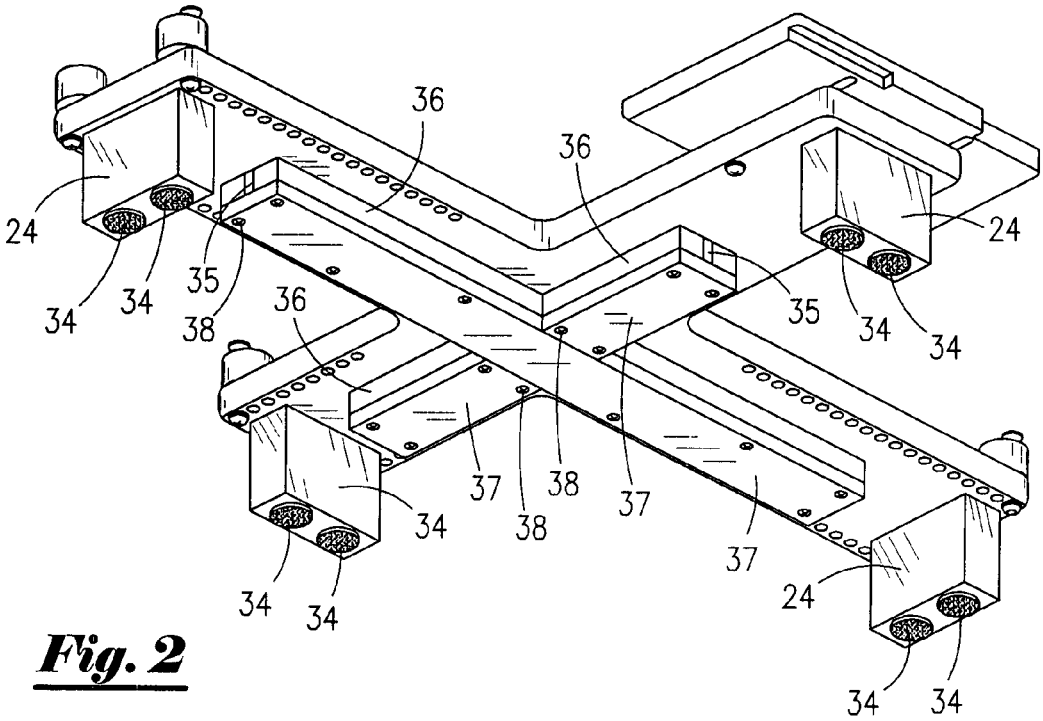
FIG. 2 is an isometric view depicting the bottom of an embodiment of applicant's invention.

FIG. 2 is an isometric view depicting the bottom of an embodiment of applicant's invention. Pads (34) are attached to base supports (24). The base channels are filed with penetrable material (35) which is a material that is able to be penetrated by a pin. The penetrable material (35) is held in place by side caps (36) and bottom caps (37). The side caps and bottom caps are secured to the base (20) by screws (38). The screws, side caps, and end caps may periodically be removed in order to access and replace the penetrable material (35) as may become necessary as a result of wear.

Figure 3:
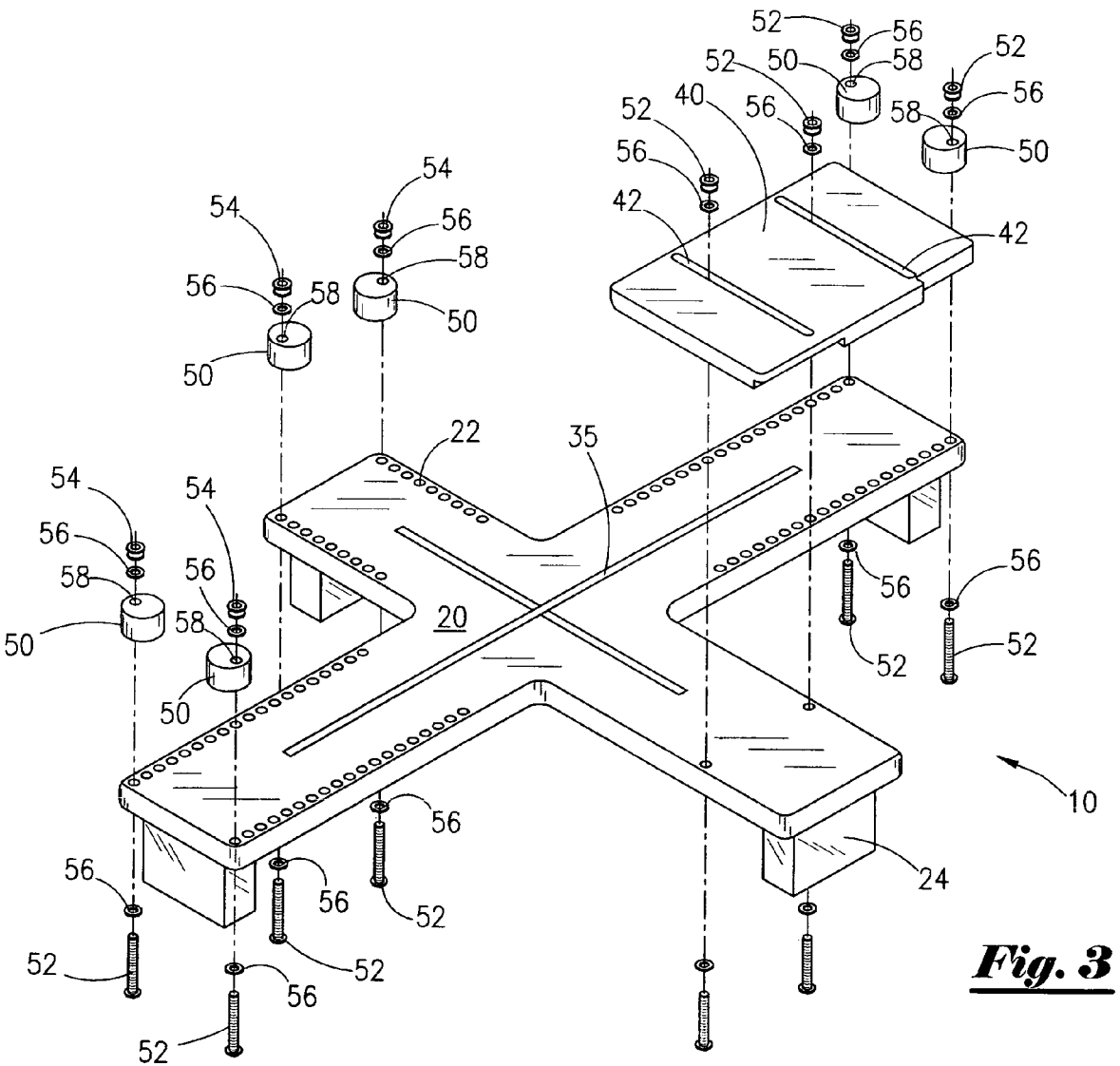
FIG. 3 is an exploded isometric view depicting the top of an embodiment of applicant's invention.

FIG. 3 is an exploded isometric view depicting the top of an embodiment of applicant's invention. Washers (56) are placed on bolts (52) between nuts (54) and knobs (50). Washers are also placed on bolts (52) between bolt heads (57) and base (20).

Knobs (50) contain knob holes (58) which are of sufficient size to allow for the through passage of bolts (52). Knob holes (58) are set off centered in the knobs (50).

Slide bar (40) contains slots (42) which are of sufficient size to allow for the through passage of bolts (52). Washers (56) are placed on bolts (52) between nuts (54) and slide bar (40). Washers are also placed on bolts (52) between bolt heads (57) and base (20).

Figure 4:
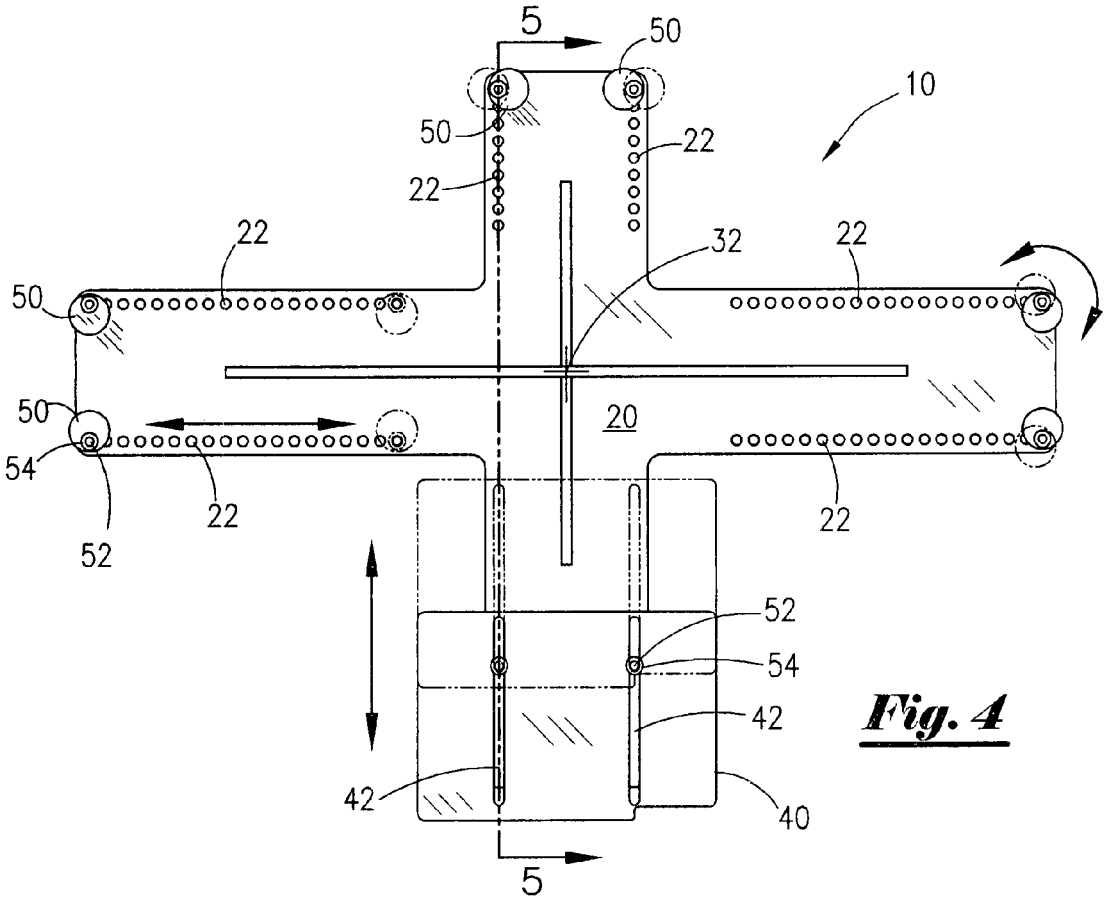
FIG. 4 is a plan view of one embodiment of applicant's invention depicting movement and positioning options for the slide bar and knobs in relation to the base.

FIG. 4 is a plan view of one embodiment of applicant's invention depicting movement and positioning options for the slide bar (40) and knobs (50) in relation to the base (20). The knobs (50) may be positioned in any of the base holes (22). The knobs, once attached to the base (20) through base holes (22), may be rotated about the bolt (52) in order to finely adjust the position of the knobs. The slide bar (40) may be positioned on the base (20) by sliding the slide bar towards and away from the base cross center point (32), with bolts (52) traveling through slots (42).

A user may place a hoop in a position on the base (20) and secure a hoop to the base by positioning and adjusting the knobs (50) and the slide bar (40).

Figure 5:
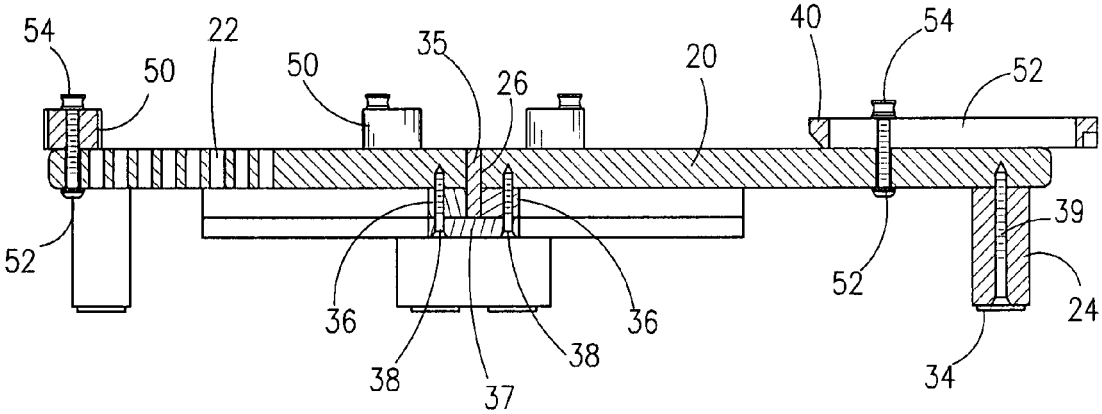
FIG. 5 is a sectional view taken along the line 5-5 in FIG. 4.

FIG. 5 is a sectional view taken along the line 5-5 in FIG. 4. Base supports (24) are secured to base (20) by base support screws (39).

Figure 6:
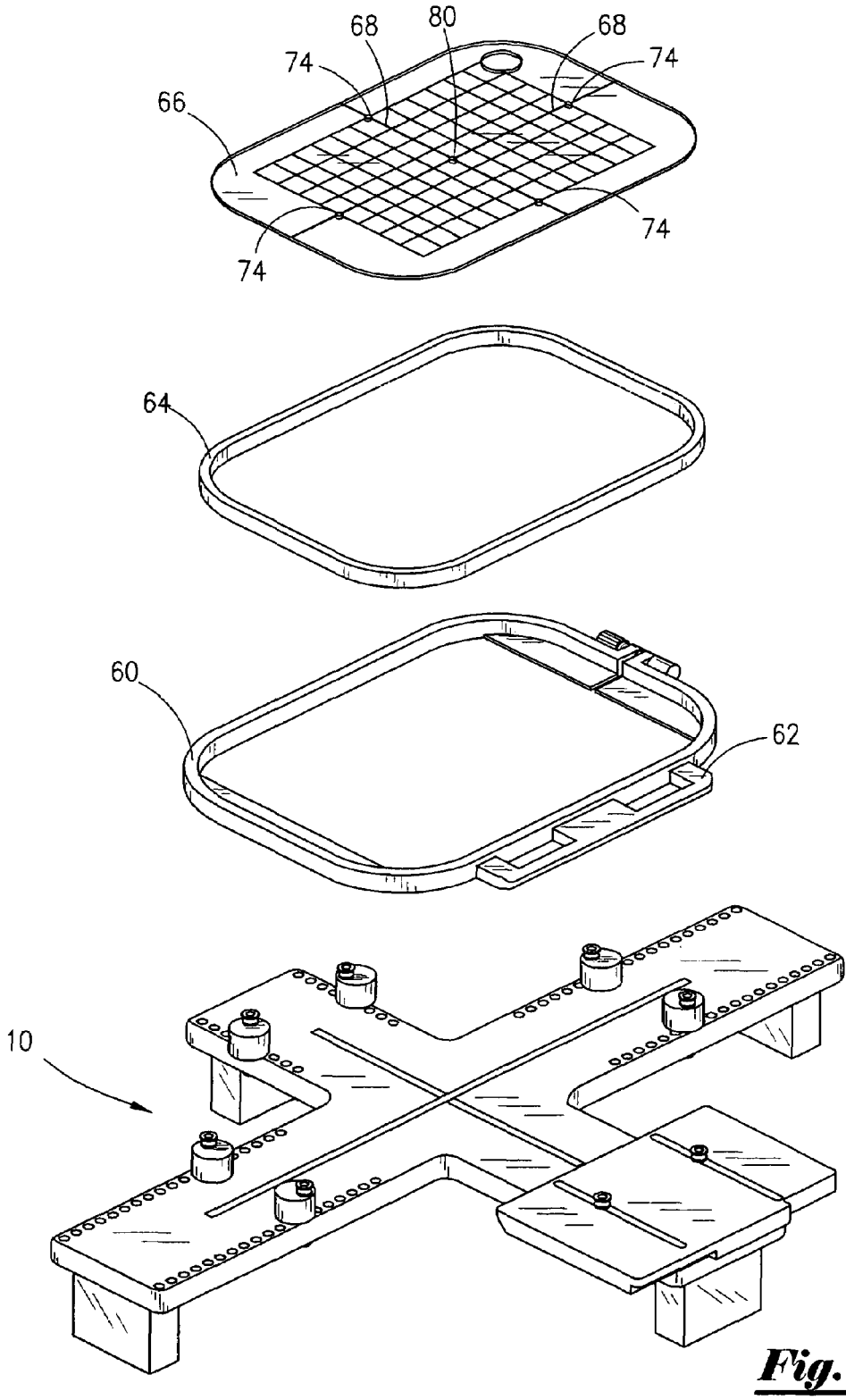
FIG. 6 is an isometric view depicting one embodiment of applicant's invention, along with a female hoop portion, male hoop portion, and plastic grid.

FIG. 6 depicts one embodiment of applicant's invention including a female hoop portion (60) having a hoop attachment boom (62), a male hoop portion (64), and grid (66). Grid (66) fits inside male hoop portion (64), which fits inside female hoop portion (60).

Figure 7:
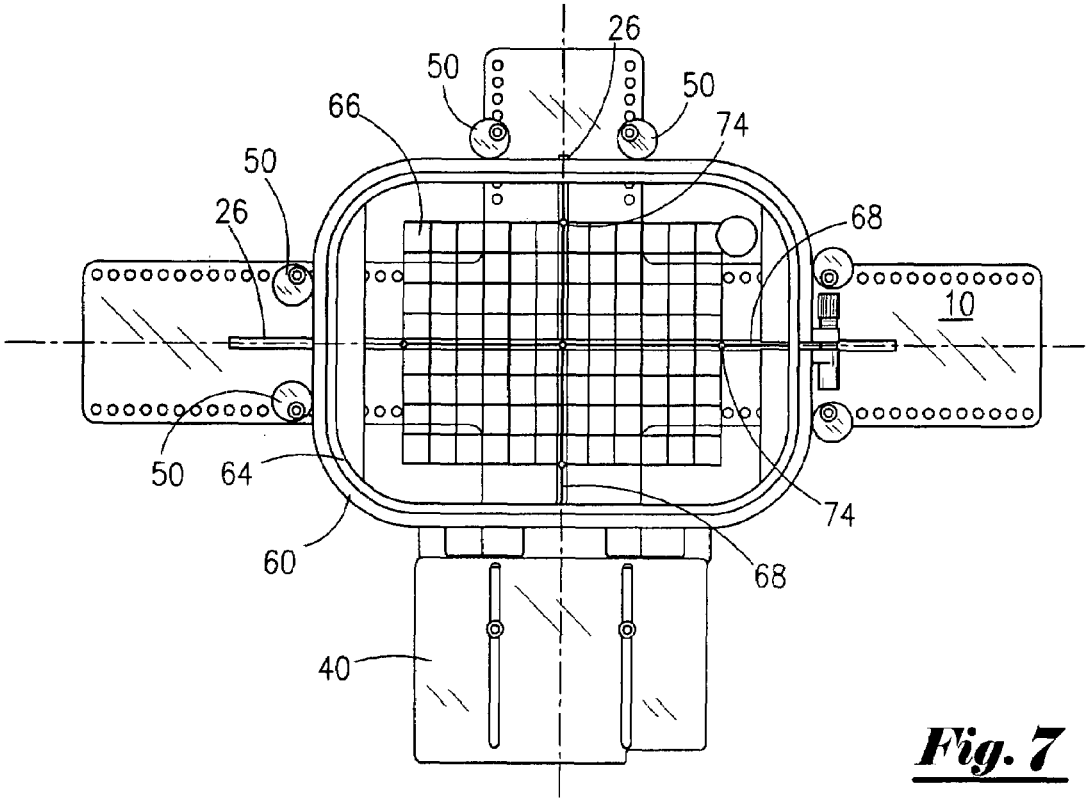
FIG. 7 is a plan view of one embodiment of applicant's invention depicting the step of positioning the hoop on the alignment apparatus and positioning and adjusting the knobs and slide bar to secure the hoop on the alignment apparatus.

FIG. 7 depicts the placing of the assembly of the female hoop portion (60), male hoop portion (64) and grid (66) on the alignment apparatus (10). The gird (66) has central axis lines (68). The assembly of the female hoop portion, male hoop portion, and grid is then positioned on the alignment apparatus (10) so that central axis lines (68) of the grid (66) correspond or line up with the base channels (26). The assembly of the female hoop portion, male hoop portion, and grid is then secured on the alignment apparatus by positioning and adjusting the knobs (50) and the slide bar (40).

Figure 8:
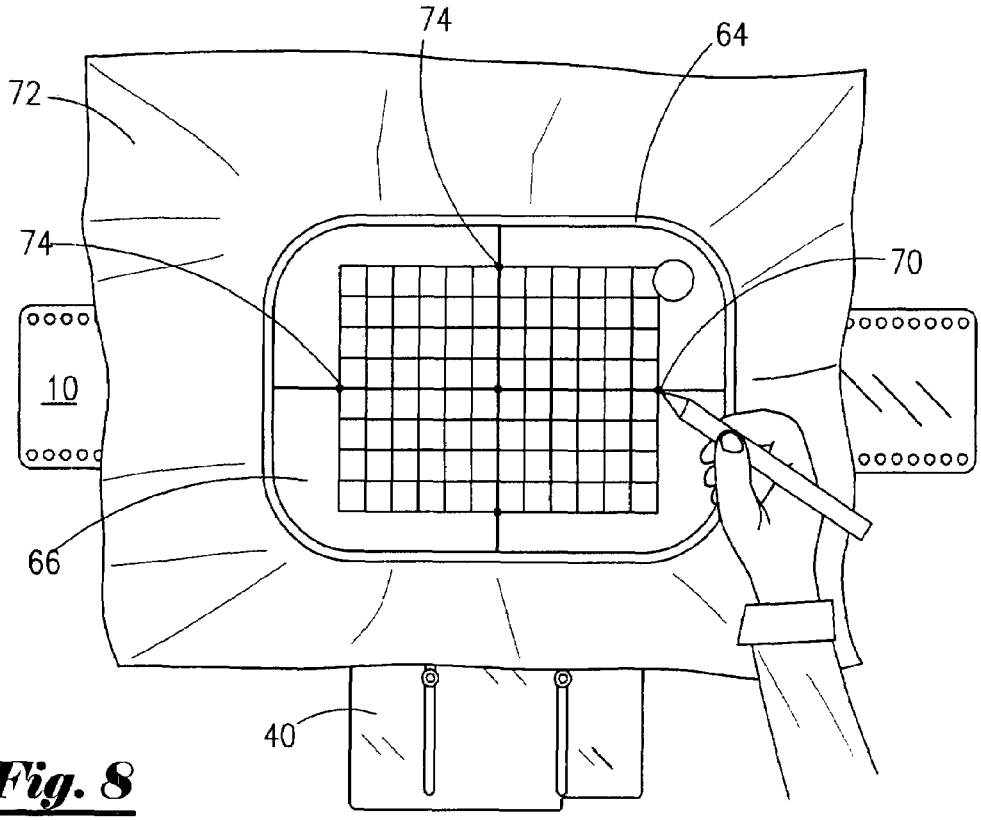
FIG. 8 is a plan view of one embodiment of applicant's invention depicting the step of placing a mark on the backer through five holes in the plastic grid.

FIG. 8 depicts a backer (72) which has been hooped between a male hoop portion (64) and a female hoop portion, and a user making a mark (70) on the backer (72) through the grid holes (74) of the grid (66).

Figure 9:
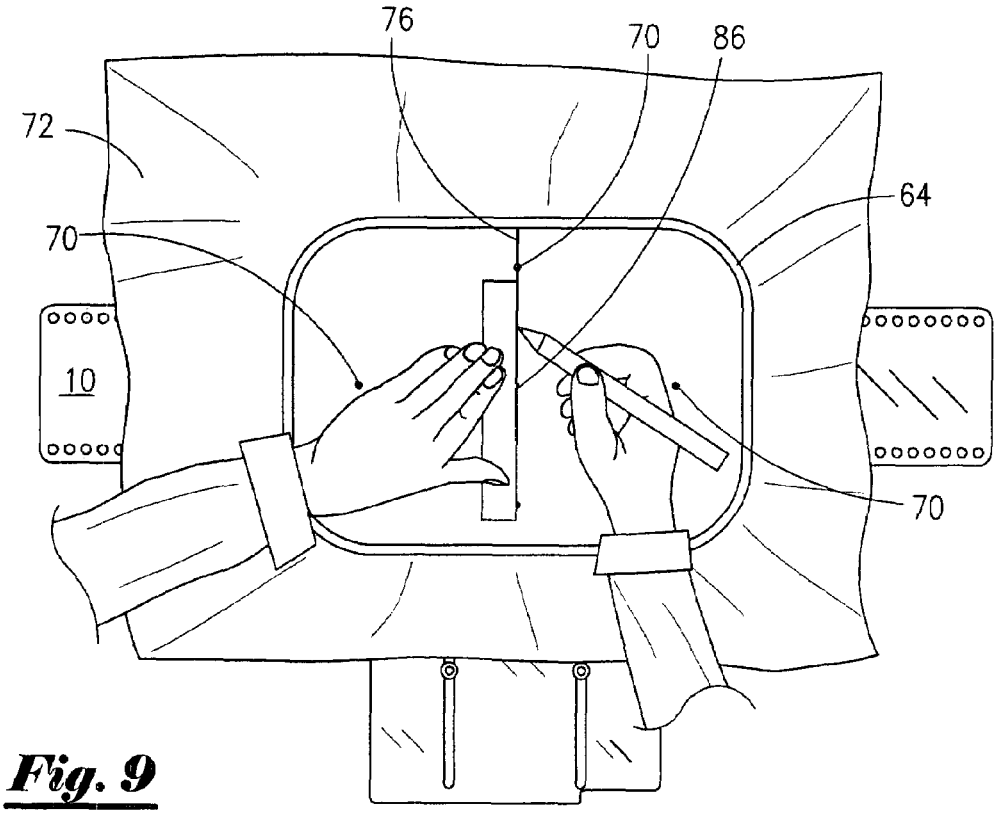
FIG. 9 is a plan view of one embodiment of applicant's invention depicting the step of drawing guide lines connecting the marks.

FIG. 9 depicts a backer (72) which has been hooped between a male hoop portion (64) and a female hoop portion. Marks (70) have been made on the backer (72). A user draws backer guide lines (76) connecting the marks on the backer so that the backer guide lines (76) intersect at the backer cross center point (86).

Figure 10:
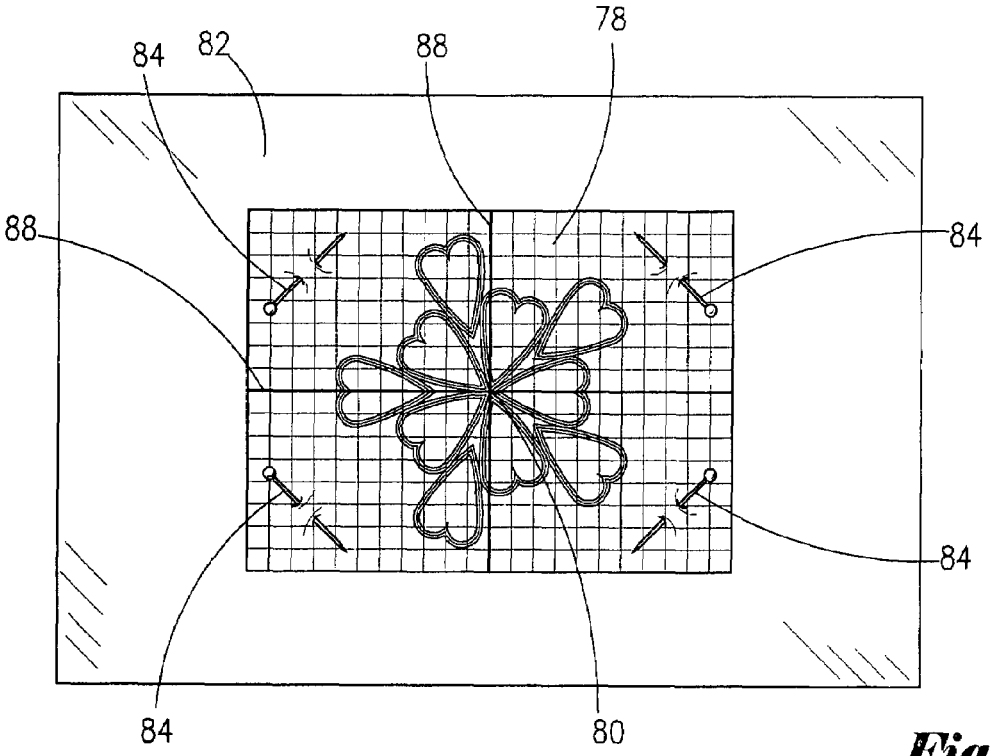
FIG. 10 is a plan view of one embodiment of applicant's invention depicting the step of positioning and pinning a design template on an article to be embroidered.

FIG. 10 depicts a design template (78) with design template guide lines (88) which intersect to form a design template cross center point (80). The design template has been placed on an article (82) to be embroidered. The design template has been positioned on the article and pinned in place by attachment pins (84).

Figure 11:
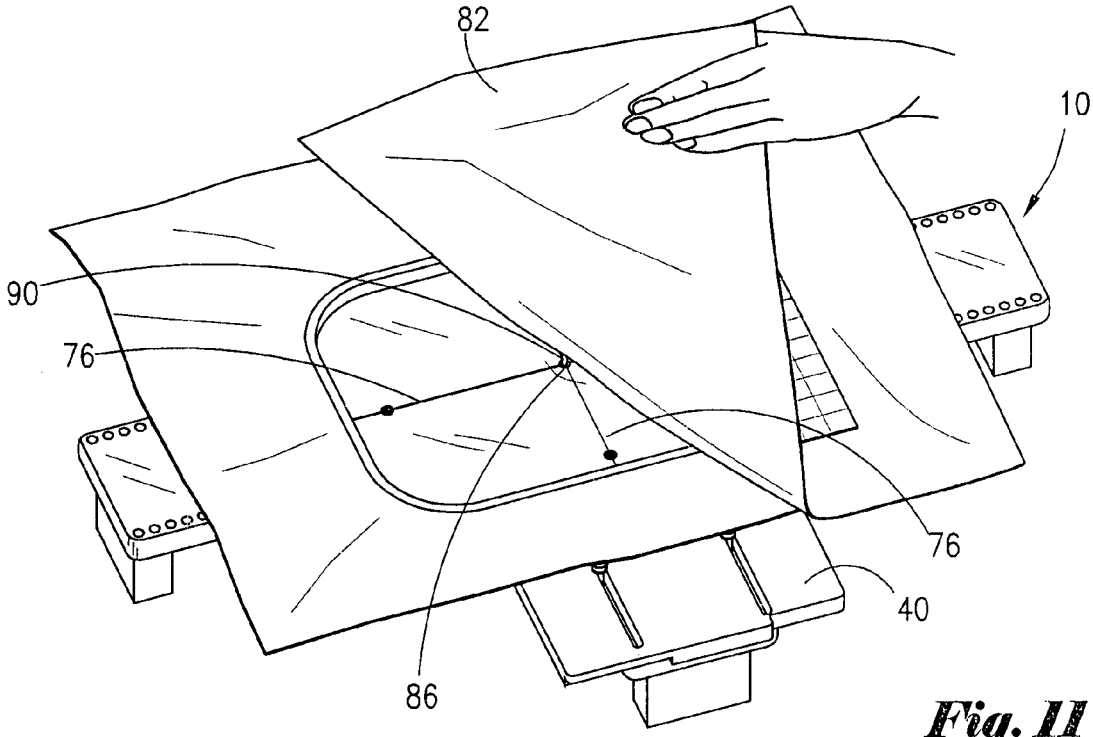
FIG. 11 is an isometric view of one embodiment of applicant's invention depicting the step of placing a pin through the design template, article, backer, and into the base cross center point.

FIG. 11 depicts a user placing a first pin (90) through the design template cross center point, the article (82), the backer cross center point (86) and into the base cross center point. A user then places second pins through the design template guide lines, the article (82), the backer guide lines (76) and into the base channel.

Figure 12:
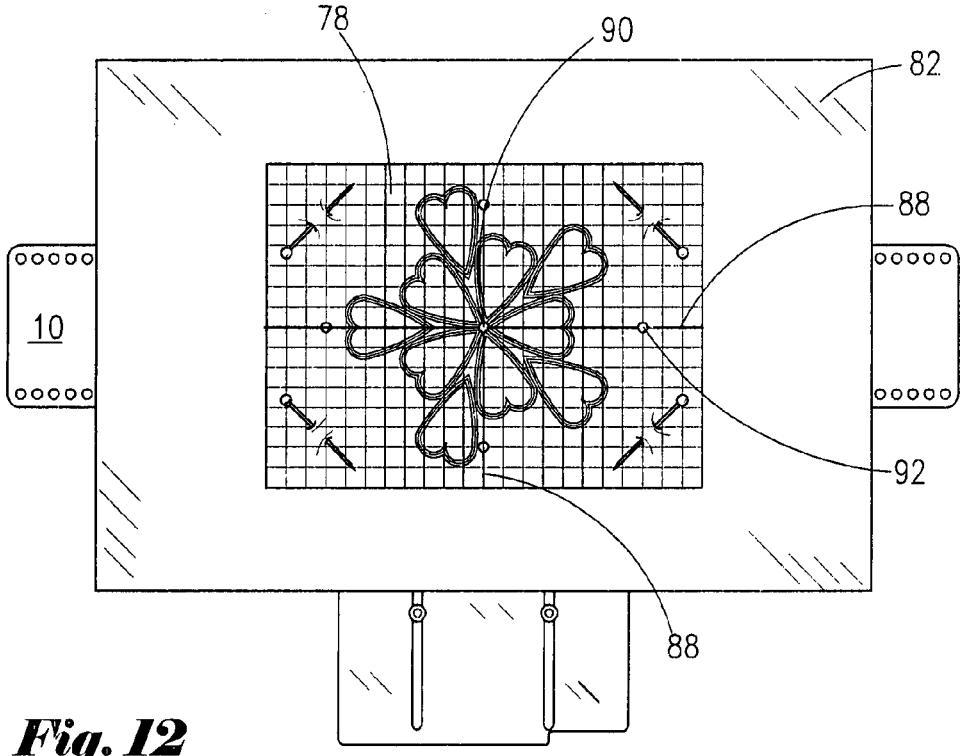
FIG. 12 is a plan view of one embodiment of applicant's invention depicting the step of placing pins through a design template guide line, an article guide line, a backer guide line, and a base channel.

FIG. 12 depicts a design template (78) which has been placed, positioned, and pinned on an article (82). A first pin (90) has been placed through the design template cross center point (80), the article (82), the backer cross center point, and into the base cross center point. Second pins (92) have been placed through the design template guide lines (88), the article (82), the backer guide lines, and into the base channel.

Figure 13:
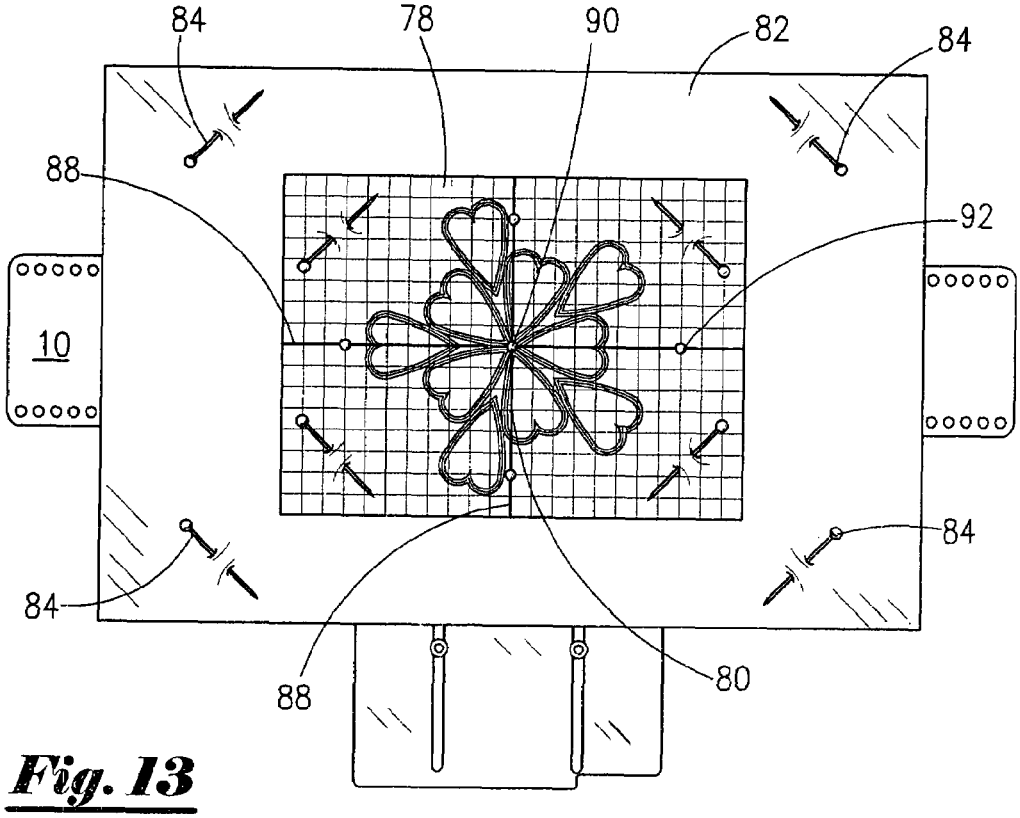
FIG. 13 is a plan view of one embodiment of applicant's invention depicting the step of placing pins around the unobstructed portions of the inner edge of the hoop.

FIG. 13 depicts a design template (78) which has been placed, positioned, and pinned on an article (82). A first pin (90) has been placed through the design template cross center point (80), the article (82), the backer cross center point, and into the base cross center point. Second pins (92) have been placed through the design template guide lines (88), the article (82), the backer guide lines, and into the base channel. Additionally, attachment pins (84) have been placed through the article (82) and backer around the inner edges of the hoop that are not obstructed by the base.

Figure 14:
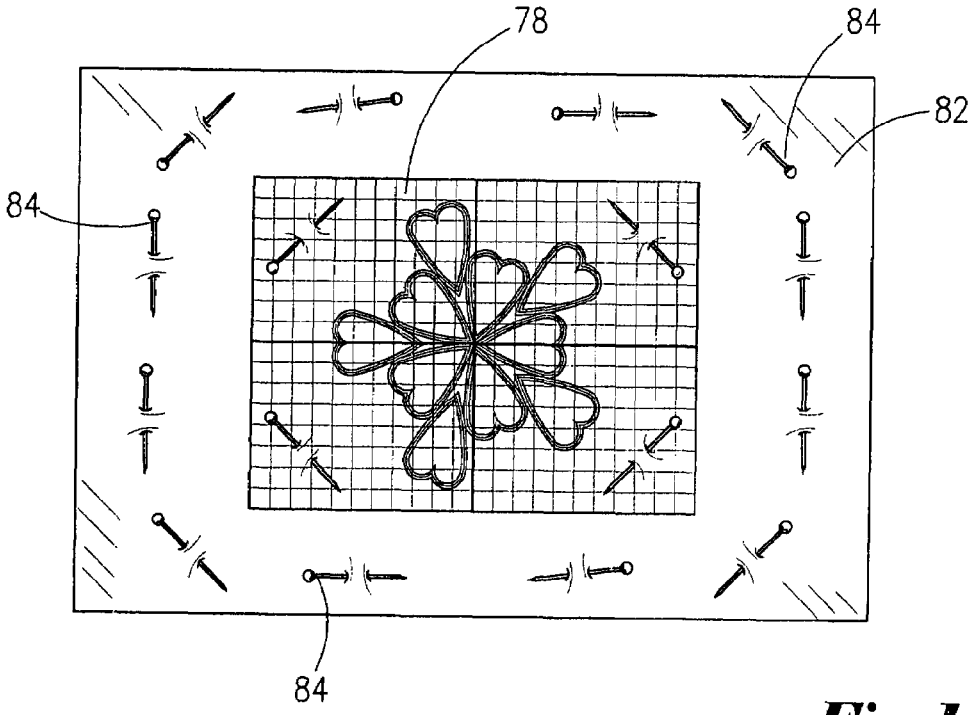
FIG. 14 is a plan view of one embodiment of applicant's invention depicting the step of lifting the hoop off of the alignment apparatus and pinning around the inner edges of the hoop that were previously obstructed by the alignment apparatus.

FIG. 14 depicts a design template (78) which has been placed, positioned, and pinned on an article (82). The design template, article, backer, and hoop assembly have been lifted off of the alignment apparatus. The first pin and second pins have been removed. Additional attachment pins have been placed through the article and backer around the inner edges of the hoop that were previously obstructed by the base.

The user now places the design template, article, backer, and hoop assembly into an embroidery machine. The needle of the embroidery machine is lowered to ensure that the needle penetrates the design template cross center point. Should the needle not precisely penetrate the center of the design template cross center point, the user may adjust the position of the needle of the embroidery machine to obtain the desired position. The design template is then removed and the embroidery machine embroiders the design on the article.

We claim:

1. An embroidery alignment apparatus comprising:

a. a base having at least one arm such that an inner edge of a hoop placed on said base is only partially obstructed by said base;

b. at least one holding member positioned on said base whereby said holding member may secure said hoop on said base; and c. a channel in said arm, wherein said channel contains a penetrable material.

2. The embroidery alignment apparatus of claim 1, wherein said base comprises two vertical arms and two horizontal arms.

3. The embroidery alignment apparatus of claim 2, wherein said holding member is a knob.

4. The embroidery alignment apparatus of claim 2, wherein said holding member is a slide bar.

5. The embroidery alignment apparatus of claim 4, wherein said holding member comprises a means for mating with a hoop attachment boom.

6. A method for aligning a design on an article to be embroidered comprising the steps of:

a. placing a hoop on a base;

b. positioning said hoop on said base;

c. securing said hoop in a position on said base;

d. hooping a backer;

e. placing an article over said backer; and f. placing pins through said article and said backer along an unobstructed inner edge of said hoop; and g. placing a grid over said hoop.

7. The method of claim 6, further comprising the step of drawing a backer guide line on said backer.

8. The method of claim 7, further comprising the step of pinning a design template on said article.

9. The method of claim 8, further comprising the step of placing a first pin through a design template cross center point, an article, a backer cross center point and a base cross center point.

10. The method of claim 9, further comprising the step of placing a second pin through a design template guide line, an article guide line, a backer guide line, and a base channel.

11. The method of claim 10, further comprising the step of placing a hoop, backer, article and design template assembly into an embroidery machine.

12. The method of claim 11, further comprising the step of lowering an embroidery machine needle to pierce said design template cross center point.

13. The method of claim 12, further comprising the step of unpinning and removing said design template from said article.

14. The method of claim 12, further comprising the step of adjusting a position of an embroidery needle.

15. The method of claim 14, further comprising the step of unpinning and removing said design template from said article.

* * * * *